US005271202A

United States Patent [19]

Vukmanic et al.

[11] Patent Number: 5,271,202

[45] Date of Patent: Dec. 21, 1993

[54] SUSPENDED CEILING SYSTEM WITH STAKED-ON CONNECTORS

[75] Inventors: Ronald W. Vukmanic, Naperville; John S. Borucki, Bloomingdale; Chester A. Stanley, Des Plaines, all of Ill.

[73] Assignee: Chicago Metallic Corporation, Chicago, Ill.

[21] Appl. No.: 881,645

[22] Filed: May 12, 1992

[51] Int. Cl.[5] ..... C04B 9/10

[52] U.S. Cl. ..... 52/667; 52/484; 52/665

[58] Field of Search ..... 52/484, 712, 489, 488, 52/780, DIG. 8, 664, 665, 667

[56] References Cited

U.S. PATENT DOCUMENTS 3,290,075 12/1966 Jahn ..... 52/484 X
3,354,598 11/1967 Nicholson .
4,108,563 8/1978 Brown et al. .
4,161,856 7/1979 Brown et al. .
4,389,828 6/1983 Cary .
4,462,198 7/1984 Sharp .
4,494,350 1/1988 Sharp .
4,601,153 7/1986 Dunn et al. .
4,611,453 8/1986 Worley .
4,779,394 10/1988 Shirey et al. .
4,989,387 2/1991 Vukmanic et al. .
5,044,138 9/1991 Zaccardelli ..... 52/484 X

*Primary Examiner*—Carl D. Friedman
*Assistant Examiner*—Beth A. Aubrey
*Attorney, Agent, or Firm*—Hill, Steadman & Simpson

[57] ABSTRACT

A staked-on connector element for an end of a cross member includes first and second abutment surfaces on opposite sides of a third abutment surface which engages a web of a main member as the connecting element extends therethrough. The connecting element further includes one or more embossments to increase the stiffness of the element and, preferably, has mounting apertures lying on a line forming an angle of approximately 55° with the center line of the connecting element with the at least one embossment extending therebetween.

20 Claims, 3 Drawing Sheets

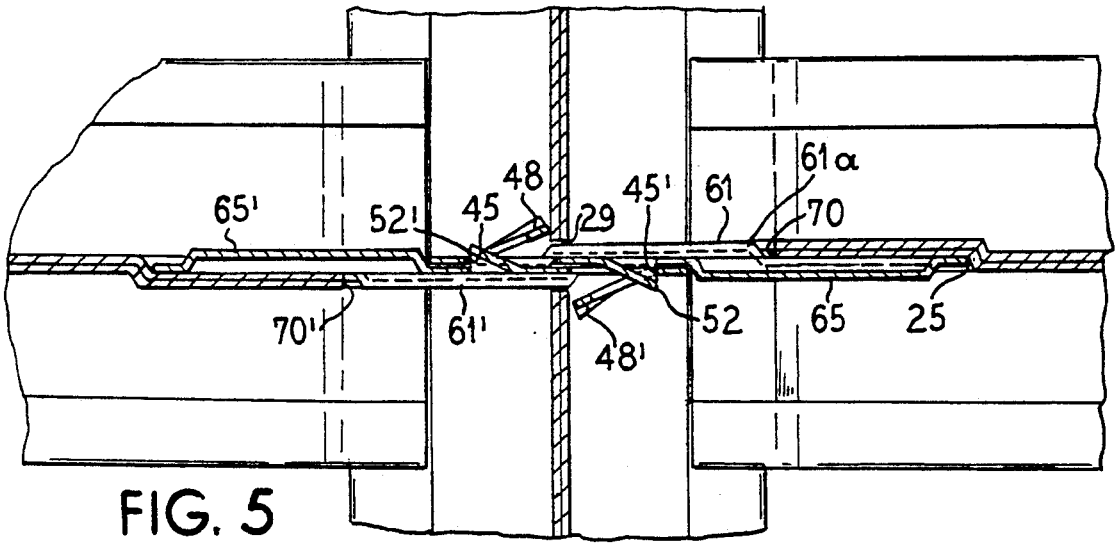
FIG. 5
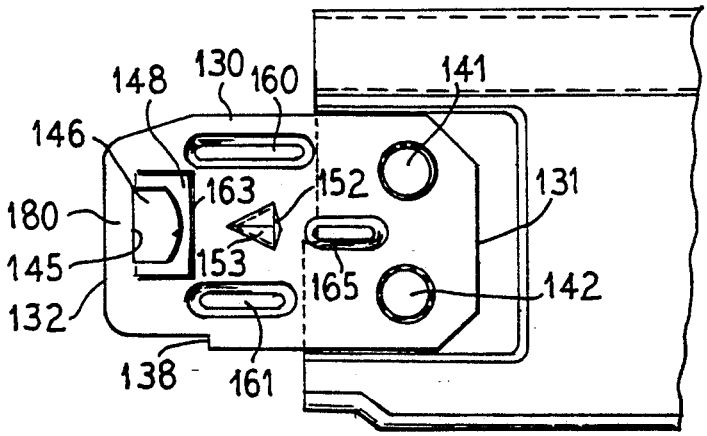
FIG. 6
FIG. 7
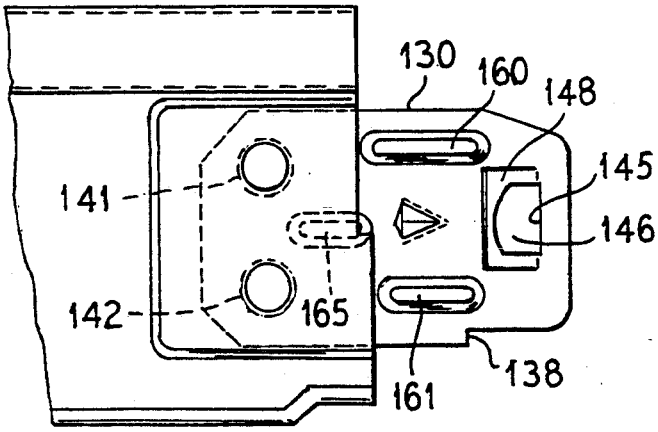

SUSPENDED CEILING SYSTEM WITH STAKED-ON CONNECTORS

BACKGROUND OF THE INVENTION

In a suspended ceiling system having main runner members and cross members arranged in a grid pattern to support ceiling panels, the present invention is directed to a staked-on connector or clip, which is attached to the ends of the cross members to be inserted through a slot in the main runner and to form a connection between the cross member and the main runner.

A staked-on connector of this type is disclosed in U.S. Pat. No. 4,989,387, whose disclosure is incorporated herein by reference thereto. This staked-on connector has a U-shaped tab bent out of one surface adjacent a distal end with an aperture forming a portion of the U-shaped tab also forming a first abutment surface, a second abutment surface being deformed out of the connector on a second surface adjacent the proximal end and a third abutment surface for engaging the web of the main runner lying on a line extending substantially midway between the first and second abutment surfaces. When this connector is inserted through a slot in a web of a main runner, the tab will engage an opposite surface of the web of the main runner and the first and second abutment surfaces will be approximately at equal distances on each side of the web of the main runner as the third abutment surface engages the web. The staked-on connector also has two spacing bumps which extend out of the first surface to engage an edge of the slot to urge the two staked-on connectors of two runners extending into the slot from opposite directions toward each other. Other staked-on connectors are disclosed in U.S. Pat. Nos. 4,108,563; 4,161,856; 4,611,453; and 4,779,394.

When utilizing a staked-on connector in a suspended ceiling system which is fire-rated, such as a system similar to that disclosed in U.S. Pat. No. 4,601,153, the third abutment surface is supposed to pierce the web of the main runner to relieve expansion forces. The connector element requires substantial rigidity to prevent buckling and/or bending. While this rigidity can be obtained in the connector disclosed in U.S. Pat. No. 4,989,387, by utilizing a thicker material for forming the staked-on connector, problems can sometimes occur.

SUMMARY OF THE INVENTION

The present invention is directed to an improvement in the staked-on connector, which has first, second and third abutment surfaces and a pair of spacing bumps, which element has sufficient rigidity to enable being used in either a fire-rated system or a seismic-rated system.

To accomplish these goals, the present invention is directed to a staked-on connector element or clip for a cross member of a suspended ceiling system, which cross member has an inverted T configuration with flanges extending on opposite sides of a web portion. The connecting element has a U-shaped tab bent out of a first surface of the element with an edge of an inner aperture forming a portion of the U-shaped tab forming a first abutment surface adjacent a distal end of the element. A portion of the element is cut and depressed out of the plane of the element on a second surface to form a second abutment surface spaced from the first abutment surface toward the proximal end of the connecting element. A third abutment surface is disposed on an edge of the element for engaging a web of a main member as the connecting element extends through a slot therein and lies on a line substantially midway between the first and second abutment surfaces. The element includes first means for spacing including a pair of spacer bumps positioned on said line outside of the U-shaped tab for engaging an edge of the opening in the web of the main runner when the connector is inserted therein, said connector element having reinforcing or second means for stiffening including the two bumps of the spacer means extending from approximately adjacent an edge of a second aperture formed by the U-shaped tab to a position beyond the second abutment surface, said reinforcing means including at least a first embossment or protrusion formed in the element to extend out of the second surface and being positioned between the proximal end of the connector element and the second abutment surface, said connector element having a pair of apertures for receiving the connecting means for staking the element onto the end of a cross member.

In the preferred embodiment, the pair of apertures are offset so as to lie on a line extending at an acute or inclined angle in a range of 50° to 60° to an upper edge of the connector element and, preferably, approximately 55°. The first embossment of the reinforcing means extends between the two apertures and overlaps one of the two spacing bumps, which have different lengths due to the forward position of one of the two apertures. In addition, the reinforcing means includes a second embossment or protrusion formed in the element toward the second surface, which second embossment is formed between the forwardmost aperture and the proximal end of the element and in line with the shorter of the two spacing bumps. In order to provide clearance for the longer of the two spacing bumps, the web of the cross member or cross runner will have a notch for receiving the bump, which will extend almost to be vertically positioned below the forwardmost of the two apertures.

With the connector element without the reinforcing means, the element may fold on a line formed by the two apertures that are positioned on a vertical line. However, the first embossment will reduce the likelihood of the folding and a first embossment extending between the two apertures, which are staggered to be on a line forming an angle such as 55° to the edge of the element will greatly reduce the chance of the element folding when subjected to compressive forces.

Another embodiment of the invention utilizes the bight portion of the U-shaped cut used in forming the tab as an engagement edge, which is engaged by a second diamond-shaped protrusion with a cut formed in the connector element between the second abutment and the U-shaped cut of the tab. This second diamond-shaped protrusion forms a fourth abutment surface, which has the abutment surface facing toward the distal end of the clip or connector element, and this fourth abutment surface will engage the edge of the bight portion of the U-shaped cut of the connector element inserted in the opposite direction to help eliminate relative movement between the two clips which may occur because of reduced metal thicknesses of the material forming the web of the main runner. To facilitate passage of the distal end of the clip over this abutment surface, a distal end is provided with a depression to form a cam means or inlet cam surface to facilitate passing over this fourth abutment surface as the connectors are moved into the slot of the web of the main runner from each direction.

Other advantages and features of the invention will be readily apparent from the following description of the preferred embodiments, the drawings and claims.

BRIEF DESCRIPTION OF THE DRAWINGS

FIG. 5 is a cross sectional view taken along the lines V—V of FIG. 4;

FIG. 6 is an enlarged side view of an end of a modification of the connector element in accordance with the present invention;

FIG. 7 is a side view of the connector element of FIG. 6 from the opposite side;

DESCRIPTION OF THE PREFERRED EMBODIMENTS

Figure 1:
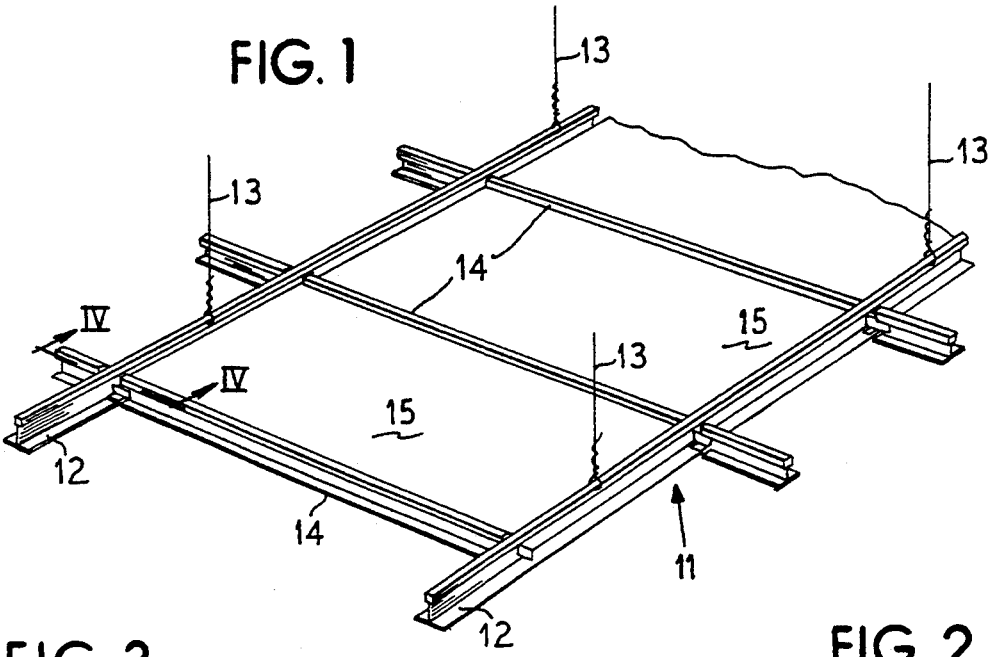
FIG. 1 is a perspective view with portions broken away for purposes of illustration of a suspended ceiling system illustrating the manner in which the various grid members are assembled to support the ceiling panels in accordance with the present invention.

The principles of the present invention are particularly useful when incorporated in a suspended ceiling system, generally indicated at 11 in FIG. 1. The suspended ceiling system 11 includes main runner members 12, which extend parallel to each other and are supported by a suspension arrangement, such as wires 13. Extending between the parallel runners 12 are cross members or runners 14, which coact with the main runners or members 12 to form a rectangular space for receiving rectangular panels, such as 15.

Figure 3:
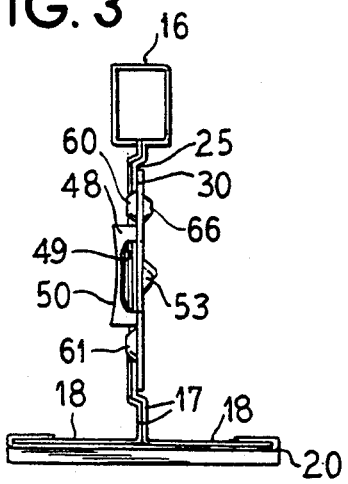
FIG. 3 is an end view of the cross runner illustrated in FIG. 2.
Figure 2:
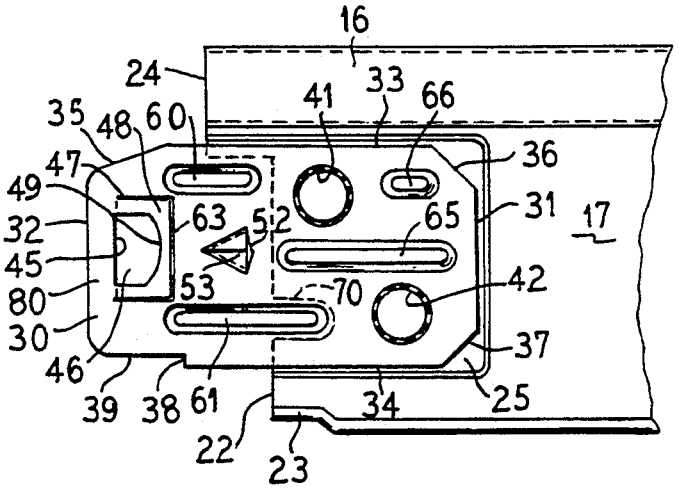
FIG. 2 is an enlarged side view of an end of a cross member illustrating the connecting tongue of the present invention.
Figure 4:
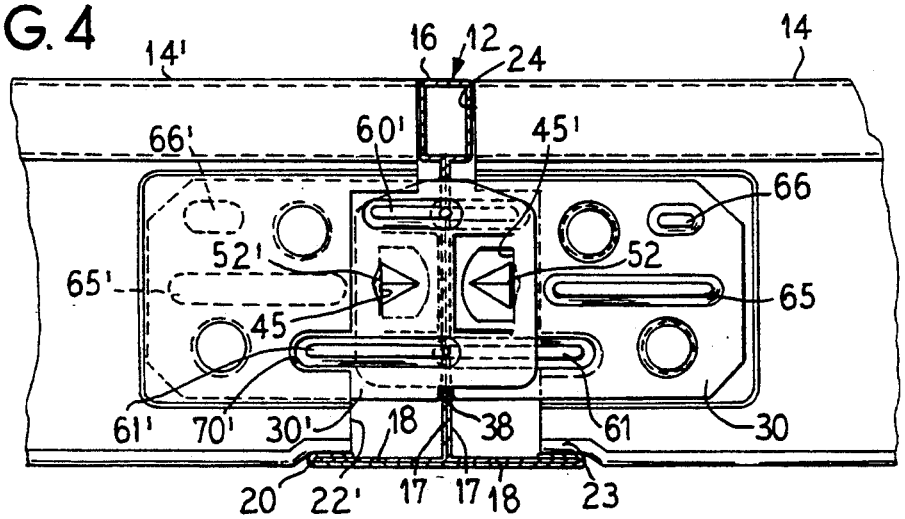
FIG. 4 is a cross sectional view taken along the lines IV—IV of FIG. 1.

As best illustrated in FIGS. 2, 3 and 4, each of the runners 12 and 14 is composed of two pieces of sheet metal, with the first piece being bent to form a hollow rectangular bead 16 with a pair of webs 17 extending downward to two outwardly extending flanges 18, 18. A cap strip 20 covers the bottom of the flanges and is bent onto the two outwardly extending edges of the flanges 18, 18. The cap strip 20 enables providing different colors or finishes to be viewed by the occupants of the room having the suspended ceiling 11.

As best illustrated in FIG. 2, each of the cross members 14 has an end edge 22 and the flanges 18, 18 and cap strip 20 are provided with a slight step 23 adjacent the end 22 to enable resting on the flanges 18 of the main runner 12, as illustrated in FIG. 4. In the embodiment illustrated in FIGS. 2 and 4, the bead 16 extends beyond the end edge 22 so that when the cross members are assembled, the ends 24 of the beads will be in contact with the bead of the main runner 12, as illustrated in FIG. 4. If the runner is to be a fire-resistant runner, then the ends 24 will be cut back to be in a vertical line substantially with the end 22 to provide a spacing between the end and the bead of the main runner 12. Such a spacing is clearly shown in the above-mentioned U.S. Pat. No. 4,601,153, whose disclosure is incorporated herein by reference thereto.

As best illustrated in FIGS. 2 and 3, the webs 17 of the runner 14 adjacent the end 22 is provided with a depression 25, which depression is equal to substantially the sum of the thickness of the material forming a connector element 30 and the thickness of the sheet metal or base metal used to form the runner 14.

The connector element or clip 30 has a proximal end 31, a distal end 32 and two sides or edges 33 and 34. The distal end 32 is connected to the edge 33 by a chamfered portion 35 and the upper edge 33 is connected by a chamfered portion 36 to the proximal end 31. The lower edge 34 is connected to the proximal end 31 by a chamfered portion or edge 37 and is provided with a step 38 that forms a third abutment surface for engaging the web of the main runner 12, as illustrated in FIG. 4. The step or third abutment surface 38 connects to an additional lower edge portion 39, which is connected by a curved corner to the distal end 32.

To mount the connector element 30 in the depression 25 of the cross member 14, the element 30 has a pair of openings or apertures 41 and 42, which, as illustrated in FIG. 2, lie on a line extending at an angle of approximately 55° to the upper edge 33. A portion of the web 17 is deformed through these apertures 41 and 42 to form an integral rivet connection.

To form a first abutment surface 45, an inner aperture 46 is formed and coacts with a second U-shaped slot or cut 47 to form a U-shaped tab 48, which is deformed out of the plane of the element 30 on a first surface. The aperture 46 has an edge 49 which is curved, and the tab 48, when bent out of the plane, has a bow, illustrated best in FIG. 3 by the curved upper edge 50. The bow 50 and the edge 49 cooperate to prevent catching of the tab 48 when pushing or inserting the connector into a slot, such as 29, of in the web 17 of the main runner 14, as illustrated in FIG. 5.

A second abutment surface 52 is formed in the element 30 by deforming a triangular or diamond portion out of a second surface opposite the first surface, as illustrated by a bump 53 in FIG. 3. Preferably, this is formed by two triangular portions so that the surface 52 will be in a vertical plane or in a plane that forms a slight hook-shape for engaging the first abutment surface, such as 45' of an element 30' illustrated in FIG. 4. The position of the first abutment surface 45 relative to the second abutment surface 52 is to be substantially equal distance from a vertical line passing through the third abutment surface formed by the step 38.

To insure that the abutment surfaces are urged into tight engagement with each other when two elements 30 and 30' are inserted from opposite directions through the slot, as illustrated in FIGS. 4 and 5, spacing means comprising a pair of spacing bumps or protrusions 60 and 61 are provided and protrude from the first surface in the same direction as the tab 48. The protrusions 60 and 61 are spaced apart a sufficient distance to be above and below the tab 48. The bump 60, which is adjacent the upper edge 33, and the bump 61, which is adjacent the lower edge 34, each extend up to a line 63 formed by the U-shaped cut 47 forming the tab 48. Each of these protrusions 60 and 61 extends from the edge 63 back to at least the second abutment surface 52. However, as illustrated, the protrusion 61 extends substantially further than the protrusion 60. These two protrusions 60 and 61 coact with protrusions or embossments 65 and 66 to form means for strengthening and rigidifying the element 30. The protrusions 65 and 66 extend from the second surface in the same direction as the protrusion 53 forming the second abutment surface 52. As best illustrated in FIG. 4, the web 17 of the cross runners 14, 14' is provided with a notch 70, 70' to receive the bump 61 or 61' so that the element can be staked-on in tight engagement with the web of the cross runner. The protrusion 65 is on a center line between the edges 33 and 34 while the protrusion 53 forming the second abutment surface 52 is on a center line between the edges 33 and 39 and slightly offset relative to the embossment 65. This protrusion 65 extends between the two apertures 41 and 42. The second protrusion or embossment 66 is on a line with the bump 60 with the forwardmost aperture 41 extending therebetween. As mentioned above, the embossments 65 and 66, along with the two bumps 60 and 61, coact together to stiffen the element 30 so that the third abutment surface 38 can act to pierce the web of the main runner 12 to relieve expansion stresses during a fire to provide a fire-rated ceiling structure. As mentioned above, the portion of the bead 16 would be cut back to be substantially in line with the edge 22. Another feature of the position of the various protrusions 60, 61, 65 and 66 is that it prevents a buckling and/or warping of the element during manufacture.

When forming the connection, the clips 30, 30' of the two cross members 14 and 14' are inserted from opposite sides of the main member 12, as illustrated in FIGS. 4 and 5. The distal ends of each of the connector elements 30, 30' will extend through the slot 29. During the connection of the first member, such as the member 14 in FIG. 5, the tab 48 will help hold the member in place until the clip 30' of the second member 14' is inserted from the left side. With insertion of the clip 30' of the second member 14', the first abutment surfaces will move over the bumps, such as 53 and 53', to allow the first abutment surface 45 to become engaged on the second abutment surface 52' as the first abutment surface 45' becomes engaged on the second abutment surface 52. As mentioned before, the protrusions, such as 61 and 61', face in opposite directions and engage opposite edges of the opening 29 to hold the abutment surfaces in tight engagement with one another.

While the embodiment of the staked-on connector 30 of FIGS. 2, 3, 4 and 5 is the preferred embodiment, a modified connector is illustrated in FIGS. 6 and 7 by the staked-on element 130. The element 130 has a similar configuration to the element 30 and is provided with a first abutment surface 145, which is formed by an inner aperture 146 for forming the tab 148. It also has a second abutment surface 152, which extends from a second surface of the element 130, which second surface is opposite the surface on which the tab 148 has been bent. The element 130 has an upper protrusion or bump 160 and a lower protrusion or bump 161 which extend from the first surface in the same direction as the tab 148 with the two protrusions or bumps 160 and 161 extending from an edge 163 of the cut for forming the tab 148 beyond the second abutment 152, with the upper bump 160 extending slightly further than the bump 161. The element 130 also has a third abutment surface 138, as in the previous embodiment, and has means coacting with the bumps 160 and 161 to strengthen or increase the rigidity of the element, which means includes a protrusion or embossment 165 that extends from the same surface as the protrusion 153 forming the second abutment surface 152 and the embossment 165 is located between the second abutment surface 152 and the proximal edge 131. In this embodiment, the apertures 141 and 142 for mounting the element 130 on the web of the cross member, such as 14, lie on a line extending substantially parallel to the proximal end 131 and perpendicular to the upper edge 133.

Figure 8:
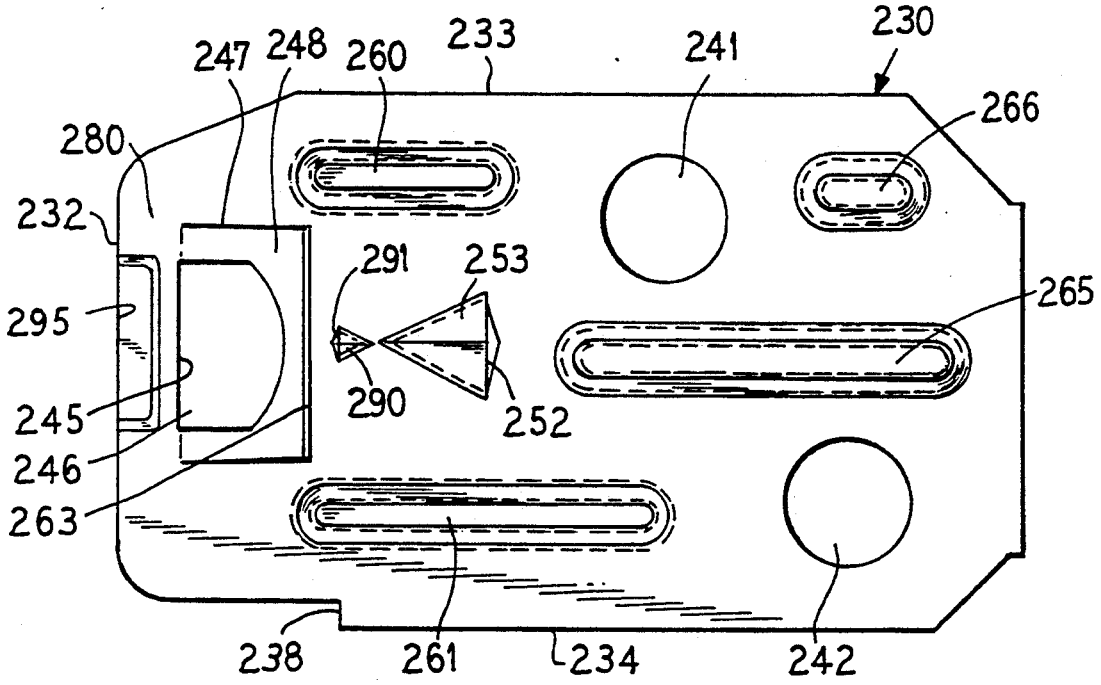
FIG. 8 is an enlarged side view of another modification of the connector element of the present invention.
Figure 9:
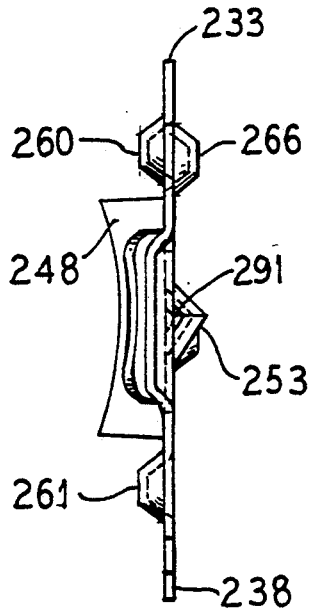
FIG. 9 is a left end view of the connector of FIG. 8.

A second modification of the connecting element or staked-on clip is illustrated by the clip generally indicated at 230 in FIGS. 8 and 9. This clip has the third abutment surface 238 adjacent a lower edge 234, has a tab 248 formed by a U-shaped slot or cut 247 and an inner aperture 246 with a distal edge 245 of the inner aperture 246 forming a first abutment surface, which cooperates with a second abutment surface 252 formed by a diamond-shaped embossment or protrusion 253. To provide spacers, spacer bumps 260 and 261 are embossed to extend out of the opposite surface from the surface of the protrusion 253. In addition, embossments 265 and 266, which are substantially similar to the embossments 65 and 66, are embossed out of the same side as the diamond-shaped protrusion 253. In this modification, an additional or second diamond-shaped protrusion 290 is embossed from the same side as the protrusion 253 to form a fourth embossment surface 291, which faces the distal end formed by the edge 232. This second diamond-shaped embossment 290 is slightly greater than a thickness of the material forming the element 230. The fourth abutment surface 291 will engage an edge 263 of the other clip, which edge is the bright portion of the cut 247 and forms a fifth abutment surface. To enable the leading end 232 to pass over this fourth abutment surface, the leading edge of the strap 280 formed between the edge 245 and the leading edge 232 is provided with a depression 295 that extends in the same direction as the tab 248. The depression 295 will, thus, act as a cam surface to guide the strap 280 over the fourth abutment surface 291 and its diamond-shaped embossment 290.

The distance between the second abutment surface 252 and the fourth abutment surface 291 is slightly less than the distance between edges 245 and 263, so that both embossment surfaces can be received in the aperture defined by the edges 263 and 245.

The object of the fourth embossment 291 is to maintain or limit relative movement between two oppositely-inserted clips, particularly when the thickness of the material forming the web for the main runner has been reduced. In other words, if the clip 230 is formed for working with main runners having a web formed of a base metal of 0.015, it can now be used with a main runner formed of a base material having a thickness of 0.010 with the fourth embossment engaging the edge 263 of the other clip to limit axial movement of the two assembled clips. It should be pointed out, however, that this clip could not be used in a fire-rated system, since the fourth abutment surface 241 engaging the edge 263 would prevent the piercing of the web of the main runner by the third abutment surface 238.

In each of the modifications, it is noted that the spacing of the second abutment surface 52, 152, 252 from the protrusion 65, 165, 265 is greater than the distance of the first abutment surface 45, 145, 245 from the distal edge 32, 132, 232 so that the strap-like portion 80 formed by the edges 32 and 45 can easily fit between the abutment surface 52 and the protrusion 65. In a similar manner, spacing between the second abutment surface 152 of the embodiment of FIGS. 6 and 7 and the protrusion 165 is greater than the width of a strap portion 180 between the first abutment surface 145 and the distal edge 132 and the distance of the second abutment surface 252 and protrusion 265 is greater than the width of the strap 280 of the embodiment of FIGS. 8 and 9.

The connecting elements are embossed out of very thin sheet metal, for example 0.018 inch thick strip of stainless steel. It is noted that the embossment or protrusion 65 is slightly offset from the embossment 53 forming the second abutment surface 52. This amount of offset is approximately one half of the width of the dome of the embossment. Also, the embossment 66 can be slightly offset from the embossment 60. It should also be noted that both the embossment 65 and 165 allow the strap portion 80, 180 to move thereover if expansion forces force the coupling into a deeper penetration, with the third abutment surface 38, 138 piercing the web of the main runner.

Also, it should be noted that the embossment or bump 61 has a slight taper so that its deepest amount is adjacent the proximal end 61*a*, as shown in FIG. 5 is approximately equal to the depth of embossment 65 and 66. The shallow part adjacent the edge 63 is the same as the bump 60 and allows clearance for the element 30 in the slot 29.

Although various minor modifications may be suggested by those versed in the art, it should be understood that we wish to embody within the scope of the patent granted hereon all such modifications as reasonably and properly come within the scope of our contribution to the art.

We claim:

1. A cross member for a suspended ceiling system, said cross member extending between a pair of main members, said cross member having an inverted T configuration with a web portion and a pair of opposite extending flanges, said cross member having a connecting element secured to an end of the cross member, said connecting element having a first surface, a second surface, a proximal end, a distal end and an upper edge and a bottom edge extending between said ends, said element having an inner aperture with an edge forming a first abutment surface adjacent the distal end of said element, a portion of the element being cut and depressed out of the plane of the element on the second surface to form a second abutment surface spaced from the first abutment surface toward the proximal end of the connecting element, a third abutment surface being disposed on one of the edges of the element approximately midway between the first and second abutment surfaces for engaging a side of the web of a main member as the connecting element extends through a slot in a web of the main member, said element having first means for spacing including a pair of protrusions extending out of the element on the first surface, said protrusions extending along a line extending parallel to the edges of the element from a position for engaging edges of the slot of the main member to a position past the second abutment surface, said element having second means for stiffening the element including at least a first embossment deformed out of said second surface of the element between the second abutment surface and the proximal end of the element, and the element having means for mounting the element on a web of the cross member including two apertures positioned between the second abutment surfaces and the proximal end in approximate alignment with the two protrusions forming the first means.

2. A cross member according to claim 1, wherein the one edge with the third abutment surface being the lower edge, the two apertures of the means for mounting lie on a line forming an angle of less than 90° with a center line of the connecting element with the forwardmost aperture of the two apertures being along the upper edge of the connecting element, one protrusion of the pair of protrusions being adjacent the third abutment surface and being longer than the other protrusion of the pair of protrusions which is adjacent the forwardmost aperture, said first embossment extending between said apertures and having a portion overlapping a portion of the one protrusion.

3. A cross member according to claim 2, wherein said second means includes a second embossment extending from said second surface in a portion of the connecting element disposed between the forwardmost aperture and the proximal end of the connecting element.

4. A cross member according to claim 1, wherein the two protrusions extending from the first side have different lengths.

5. A cross member according to claim 1, wherein the second means for stiffening includes a second embossment extending from said second surface.

6. A cross member according to claim 1, wherein the two apertures are disposed on a line extending at an acute angle to a center line of the connecting element.

7. A cross member according to claim 6, wherein the first embossment extends between the two apertures.

8. A cross member according to claim 7, wherein the second means includes a second embossment extending from the second surface, said second embossment being substantially shorter than the first embossment and being disposed between the proximal end and one of the apertures.

9. A cross member according to claim 7, wherein the protrusion adjacent the bottom edge of the connecting element is a longer protrusion than the other protrusion and the end of the web of the cross member has a notch for receiving a portion of the longer protrusion which overlaps with a portion of the first embossment of the second means.

10. A cross member according to claim 9, which includes a second protrusion extending out of the second surface to form a fourth abutment surface between the first and second abutment surfaces and facing toward the distal edge of the connecting element to engage an edge of a U-shaped slot forming a U-shaped tab in the connecting element inserted from the opposite direction to limit relative movement between the connecting elements.

11. A cross member according to claim 10, which includes cam means being formed on a strap portion between the first abutment surface and the distal end to facilitate movement of the strap portion over the second protrusion forming the fourth abutment surface.

12. A cross member according to claim 2, wherein said line forms an angle in a range of 50° to 60°.

13. A cross member according to claim 2, wherein the web of the cross member has a slot adjacent the end thereof for receiving a portion of the one protrusion.

14. A cross member according to claim 13, wherein said one protrusion has a tapering height with a shallow portion being the height of the other protrusion.

15. A suspended ceiling system comprising main members extending parallel to each other and cross members extending between the main members at spaced intervals, each of said members having an inverted T configuration with a pair of oppositely extending flanges connected by a web to a bead, each cross member having an end with a connecting element staked onto the web to extend beyond the end edges of the web and the end of the bead and flanges, each of the webs in the main members having elongated slots for receiving the connecting elements of the cross member with the ends of the flanges of the cross members contacting the flanges of the main member, each of the connecting elements having an aperture forming a first abutment surface, a protrusion extending from one surface of the connecting element to form a second abutment surface, a stepped edge forming a third abutment surface disposed on a line substantially midway between the first and second abutment surfaces, said third abutment surface engaging a web of the main member as the connecting element extends through the main member with the first and second abutment surfaces being disposed on opposite sides of the web of the main member at a substantially equal distance therefrom, spacing means including two bumps extending from the other surface of said element with the bumps having a length extending from a position engaging the edges of the slot of the main member and extending past the second abutment surface, stiffening means including a first embossment extending from said first surface approximately along a center line of the connecting element and being spaced between the second abutment surface and a proximal end of the connecting element, and mounting means including a pair of apertures for receiving fastening means for fastening the connector onto the web of the cross member so that with the connector extending through the slot and the main member, the first and second abutment surface of a connector of one cross member coact with the connecting element of the other cross member to form an interlocking connection of the two cross members onto the main member.

16. A suspended ceiling system according to claim 15, wherein each of the connecting elements further includes a U-shaped tab surrounding the first-mentioned aperture and being bent out of the connector element toward the other side, said tab engaging a surface of the web when the connecting element is inserted with the third abutment surface engaging the other surface of the web.

17. A suspended ceiling system according to claim 16, wherein the pair of apertures are disposed on a line inclined to a center line of said connecting element, said first embossment of the stiffening means extending between said apertures, and said stiffening means including a second embossment extending from the one side being disposed between the proximal edge and the aperture positioned closest to the distal edge of the connecting element.

18. A suspended ceiling system according to claim 17, wherein each of the connecting elements have one bump substantially in line with the aperture closest to the proximal end of the connecting element being substantially longer than the other bump to overlap a portion of the first embossment, and said web of the cross member having a notch for receiving a portion of the one bump.

19. A suspended ceiling system according to claim 18, wherein the one bump has a tapering height configuration from a height of the other bump to a height equal to the height of the first embossment.

20. A suspended ceiling system according to claim 19, which includes a second diamond-shaped protrusion forming a fourth abutment surface facing the distal end of the connecting element being positioned adjacent a U-shaped cut forming said tab having a bright portion forming a fifth abutment surface, said fourth and fifth abutment surfaces coacting with the fourth and fifth abutment surfaces of the opposite cross member to limit axial movement between the cross members inserted in the slot in the main member, each of the connecting elements having cam surfaces formed by a depression adjacent the distal end to facilitate passing the distal end over the fourth abutment surface.

* * * * *